US009546633B2

(12) United States Patent
Bandyopadhyay et al.

(10) Patent No.: US 9,546,633 B2
(45) Date of Patent: Jan. 17, 2017

(54) NOZZLE FOR SKEWED FUEL INJECTION

(75) Inventors: Deep Bandyopadhyay, Naperville, IL (US); Michael B. Goetzke, Orland Park, IL (US); Raghavendra Subramanya, Burr Ridge, IL (US)

(73) Assignee: Electro-Motive Diesel, Inc., La Grange, IL (US)

( * ) Notice: Subject to any disclaimer, the term of this patent is extended or adjusted under 35 U.S.C. 154(b) by 1128 days.

(21) Appl. No.: 13/435,813

(22) Filed: Mar. 30, 2012

(65) Prior Publication Data

US 2013/0255622 A1 Oct. 3, 2013

(51) Int. Cl.
*F02M 61/18* (2006.01)

(52) U.S. Cl.
CPC ..... *F02M 61/1806* (2013.01); *F02M 61/1813* (2013.01)

(58) Field of Classification Search
CPC F02B 17/005; F02B 2075/125; Y02T 10/125; Y02T 10/123; Y02T 10/44
USPC ..... 123/305, 294; 239/533.1, 533.2, 533.3, 239/533.4
See application file for complete search history.

(56) References Cited

U.S. PATENT DOCUMENTS 3,531,052 A * 9/1970 Berlyn ..... 239/533.7
4,069,978 A * 1/1978 El Moussa ..... F02M 61/1806 219/121.13
4,467,966 A 8/1984 Mueller
5,016,820 A * 5/1991 Gaskell ..... B23H 9/00 239/533.12
5,271,563 A * 12/1993 Cerny ..... B05B 1/3421 239/463
5,667,145 A * 9/1997 Schmidt ..... F02M 61/1826 239/533.12
5,878,962 A 3/1999 Shen et al.
6,029,913 A * 2/2000 Stroia ..... F02M 61/1806 239/533.12
6,047,905 A 4/2000 Honda et al.
6,142,392 A * 11/2000 Takeda ..... F02M 61/1833 239/533.12
6,308,901 B1 10/2001 Nitkiewicz et al.
6,494,388 B1 * 12/2002 Mueller et al. ..... 239/533.12
6,543,702 B1 4/2003 Stier
6,752,333 B2 6/2004 Hohl
6,935,578 B1 8/2005 Shibata et al.
6,938,840 B1 9/2005 Trutschel et al.
7,082,921 B2 8/2006 Shimizu et al.
7,337,986 B2 3/2008 Fukutomi
8,672,239 B2 * 3/2014 Ogura et al. ..... 239/533.12
(Continued)

FOREIGN PATENT DOCUMENTS

CN 101305181 A 11/2008
DE 19642513 * 4/1998
(Continued)

*Primary Examiner* — Hai Huynh
*Assistant Examiner* — Raza Najmuddin
(74) *Attorney, Agent, or Firm* — Finnegan, Henderson, Farabow, Garrett & Dunner, LLP

(57) ABSTRACT

A nozzle for a fuel injector is disclosed. The nozzle may have a body having a base end, a tip end, and a central bore extending from the base end to the tip end. The nozzle may also have a sac located within the central bore at the tip end. Further, the nozzle may have an orifice located within the tip end and in communication with the sac. The orifice may be skewed at an azimuthal angle relative to a radial direction of the central bore.

13 Claims, 3 Drawing Sheets

(56) References Cited

U.S. PATENT DOCUMENTS

| | | | | |
|---|---|---|---|---|
| 2002/0043574 | A1* | 4/2002 | Hunkert | F02M 61/1806 239/533.3 |
| 2003/0075619 | A1* | 4/2003 | Park | F02M 51/061 239/463 |
| 2006/0192036 | A1* | 8/2006 | Joseph | F02M 61/182 239/596 |
| 2007/0040053 | A1* | 2/2007 | Date | F02M 61/1846 239/533.2 |
| 2007/0175440 | A1* | 8/2007 | Lippert et al. | 123/305 |
| 2009/0020633 | A1* | 1/2009 | Limmer | F02M 61/1806 239/533.12 |
| 2010/0224706 | A1 | 9/2010 | Suzuki et al. | |

FOREIGN PATENT DOCUMENTS

| | | | |
|---|---|---|---|
| EP | 2390491 | * | 11/2011 |
| WO | 03078824 | | 9/2003 |

* cited by examiner

NOZZLE FOR SKEWED FUEL INJECTION

TECHNICAL FIELD

The present disclosure relates generally to a fuel injector nozzle and, more particularly, to a nozzle used for skewed fuel injection.

BACKGROUND

Internal combustion engines such as diesel engines, gasoline engines, and gaseous fuel powered engines use injectors to introduce fuel at high pressure into combustion chambers of the engines. Each of these fuel injectors includes a nozzle having one or more orifices that direct the pressurized fuel radially outward from the nozzle into the associated combustion chamber.

During injection, however, air entering an engine's combustion chamber naturally swirls in either a clockwise or counter-clockwise direction. Spraying fuel radially outward from the nozzle in the presence of such swirl can cause incomplete atomization or improper mixing of the fuel with the air. This may result in decreased performance of the fuel injector, which may be manifested through reduced engine efficiency, increased soot formation, and increased fuel consumption.

U.S. Pat. No. 7,082,921 B2 to Shimizu et al. ("the '921 patent") describes a fuel injector for an internal combustion engine in which fuel is injected from a single orifice of the fuel injector into a combustion chamber. The orifice is slanted at a predetermined angle with respect to a central axis. The orifice also has a step which induces swirl in the fuel sprayed into the combustion chamber to improve atomization of the fuel.

Although the '921 patent discloses a fuel injector which induces swirl in the fuel spray, the disclosed fuel injector does not account for the effects of swirling air entering the combustion chamber and may still cause incomplete atomization and improper mixing of fuel with air.

The nozzle of the present disclosure solves one or more of the problems set forth above and/or other problems in the art.

SUMMARY

In one aspect, the present disclosure is directed to a nozzle for a fuel injector. The nozzle may include a body having a base end, a tip end, and a central bore extending from the base end to the tip end. The nozzle may also include a sac located within the central bore at the tip end. In addition, the nozzle may include an orifice located within the tip end and in communication with the sac. The orifice may be skewed at an azimuthal angle relative to a radial direction of the central bore.

In another aspect, the present disclosure is directed to a method of injecting fuel in an engine having a combustion chamber. The method may include pressurizing fuel. The method may also include directing a flow of pressurized fuel through a central bore of a nozzle member to a sac. In addition, the method may include redirecting the fuel through an orifice to the combustion chamber in a direction skewed at an azimuthal angle relative to a radial direction of the central bore.

DETAILED DESCRIPTION

Figure 1:
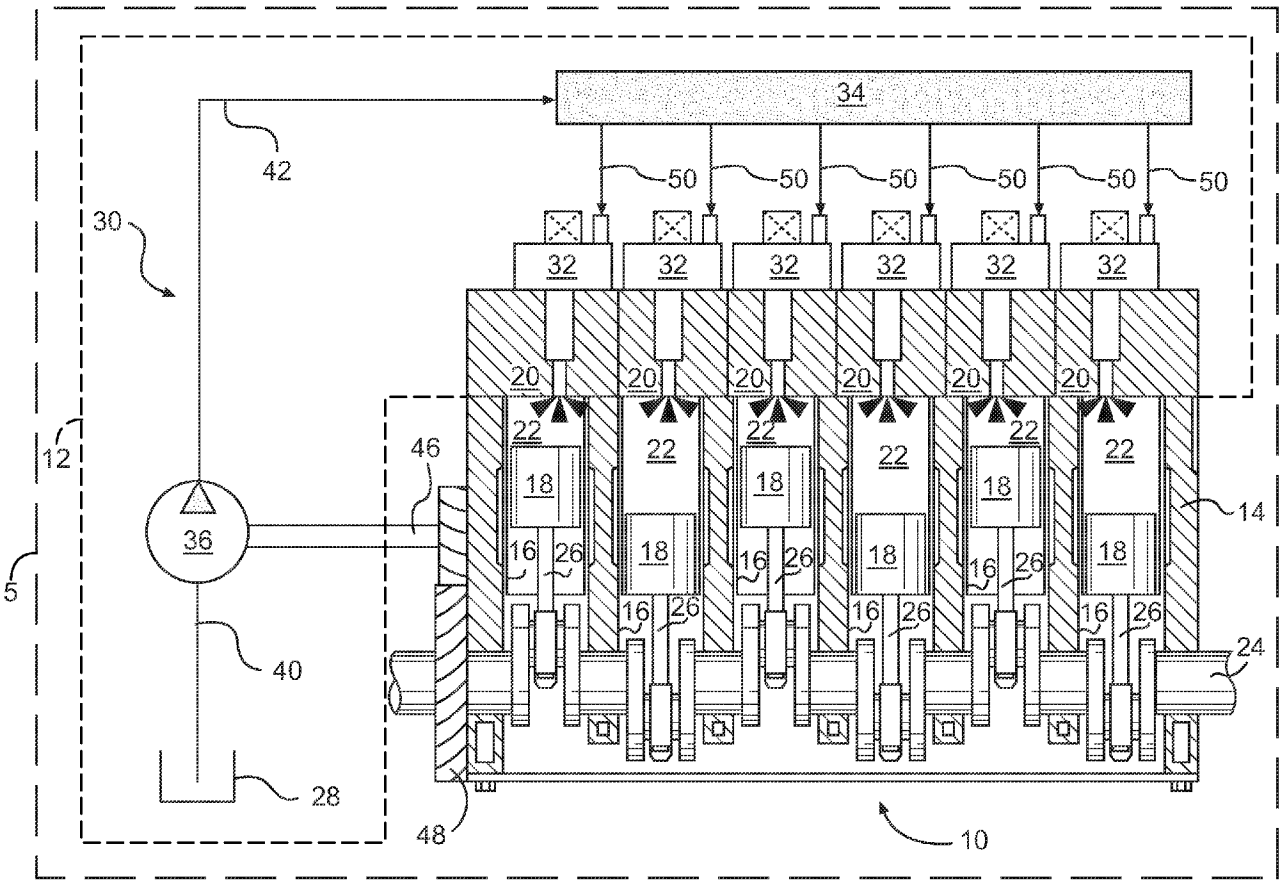
FIG. 1 is a schematic and diagrammatic illustration of an exemplary disclosed machine.

FIG. 1 illustrates a machine 5 having an engine 10 and a fuel system 12. Machine 5 may be a fixed or mobile machine that performs some type of operation associated with an industry such as railroad, marine, mining, construction, farming, power generation, or any other industry known in the art. For example, machine 5 may embody a locomotive, a marine engine, an earth moving machine, a generator set, a pump, or another suitable operation-performing machine.

In one exemplary embodiment of machine 5, engine 10 may be a two-stroke diesel engine. One skilled in the art will recognize, however, that engine 5 may be any other type of internal combustion engine such as, for example, a four-stroke diesel engine, a gasoline engine, or a gaseous fuel-powered engine. Engine 10 may include an engine block 14 that at least partially defines a plurality of cylinders 16, a piston 18 slidably disposed within each cylinder 16, and a cylinder head 20 associated with each cylinder 16. Cylinder 16, piston 18, and cylinder head 20 may form a combustion chamber 22. In the embodiment illustrated in FIG. 1, engine 10 includes six combustion chambers 22. However, it is contemplated that engine 10 may include a greater or lesser number of combustion chambers 22. Moreover, combustion chambers 22 may be disposed in an "in-line" configuration, a "V" configuration, or any other suitable configuration.

As also shown in FIG. 1, engine 10 may include a crankshaft 24 rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 may include components that cooperate to deliver injections of pressurized fuel into each combustion chamber 22. Specifically, fuel system 12 may include a tank 28 configured to hold a supply of fuel, and a fuel pumping device 36 configured to receive fuel from supply line 40. Fuel pumping device 36 may pressurize the fuel and direct the pressurized fuel via supply line 42 to a plurality of fuel injectors 32 by way of a common rail 34. It is contemplated that additional or different components may be included within fuel system 12, if desired, such as, for example, additional fuel pumping devices, high and low pressure sources, debris filters, water separators, makeup valves, relief valves, priority valves, and energy regeneration devices.

Pumping device 36 may be operatively connected to engine 10 and driven by crankshaft 24. Moreover, pumping device 36 may be connected with crankshaft 24 in any manner readily apparent to one skilled in the art where a rotation of crankshaft 24 will result in a corresponding rotation of a pump drive shaft. For example, a pump driveshaft 46 of pumping device 36 is shown in FIG. 1 as being connected to crankshaft 24 through a gear train 48. It is contemplated, however, that pumping device 36 may alternatively be driven electrically, hydraulically, pneumatically, or in any other appropriate manner.

Fuel injectors 32 may be disposed within cylinder heads 20 and fluidly connected to common rail 34 by a plurality of distribution lines 50. Each fuel injector 32 may be operable to inject an amount of pressurized fuel into an associated combustion chamber 22 at predetermined timings, fuel pressures, and fuel flow rates. The timing of fuel injection into combustion chamber 22 may be synchronized with the motion of piston 18. For example, fuel may be injected as piston 18 nears a top-dead-center position during a compression stroke to allow for compression-ignited combustion of the injected fuel. Alternatively, fuel may be injected as piston 18 begins the compression stroke heading towards a top-dead-center position for homogenous charge compression ignition operation. Fuel may also be injected as piston 18 moves from a top-dead-center position towards a bottom-dead-center position during an expansion stroke for a late post injection to create a reducing atmosphere for aftertreatment regeneration.

Figure 2:
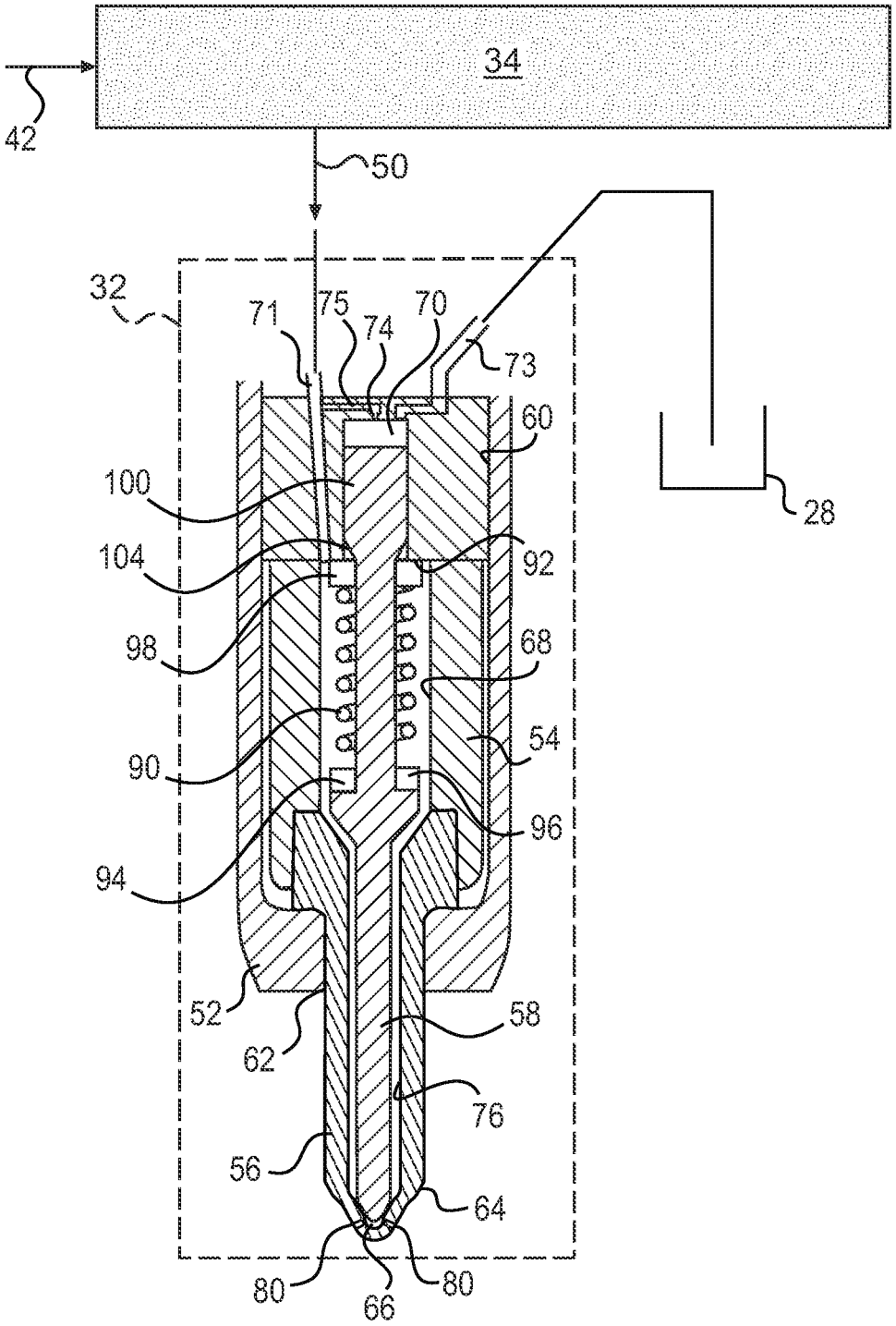
FIG. 2 is a cross-sectional illustration of an exemplary disclosed fuel injector for the machine of FIG. 1.

FIG. 2 illustrates a cross-sectional view of a fuel injector 32 that may be used in conjunction with engine 10 shown in FIG. 1. Specifically, each fuel injector 32 may include an injector body 52 housing a guide 54, a nozzle member 56, and a needle valve element 58. It is contemplated that each fuel injector 32 may include additional or different components than those illustrated in FIG. 2, if desired, such as, for example, solenoid actuators and additional valve elements. It is further contemplated that fuel injectors 32 may alternatively embody other types of fuel injection devices such as, for example, mechanically-actuated electronically-controlled injectors, digitally-controlled fuel valves, or any other type of fuel injector known in the art.

Injector body 52 may be a cylindrical member configured for assembly within cylinder head 20. Injector body 52 may have a central bore 60 for receiving guide 54 and nozzle member 56, and an opening 62 through which a tip end 64 of nozzle member 56 may protrude. A sealing member such as, for example, an o-ring (not shown) may be disposed between guide 54 and nozzle member 56 to restrict fuel leakage from fuel injector 32.

Guide 54 may also be a cylindrical member having a central bore 68 configured to receive needle valve element 58, and a control chamber 70. Central bore 68 may act as a pressure chamber, holding pressurized fuel that is supplied from a fuel supply passageway 71. During injection, the pressurized fuel from distribution line 50 may flow through fuel supply passageway 71 and central bore 68 to nozzle member 56.

Control chamber 70 may be selectively drained of or supplied with pressurized fuel to cause needle valve element 58 to move. Specifically, a control passageway 73 may fluidly connect control chamber 70 with fuel tank 28 for draining and filling of control chamber 70. Control chamber 70 may also be supplied with pressurized fluid via a supply passageway 75 and a port 74 that is axially aligned with needle valve element 58 and in communication with fuel supply passageway 71. A diameter of port 74 may be less than diameter of control passageway 73 and supply passageway 75 to allow for a pressure drop within control chamber 70 when control passageway 73 is drained of pressurized fuel. When control chamber 70 is filled with fuel, needle valve element 58 may move down. When control chamber 70 is drained of fuel, needle valve element 58 may move up.

Figure 3A:
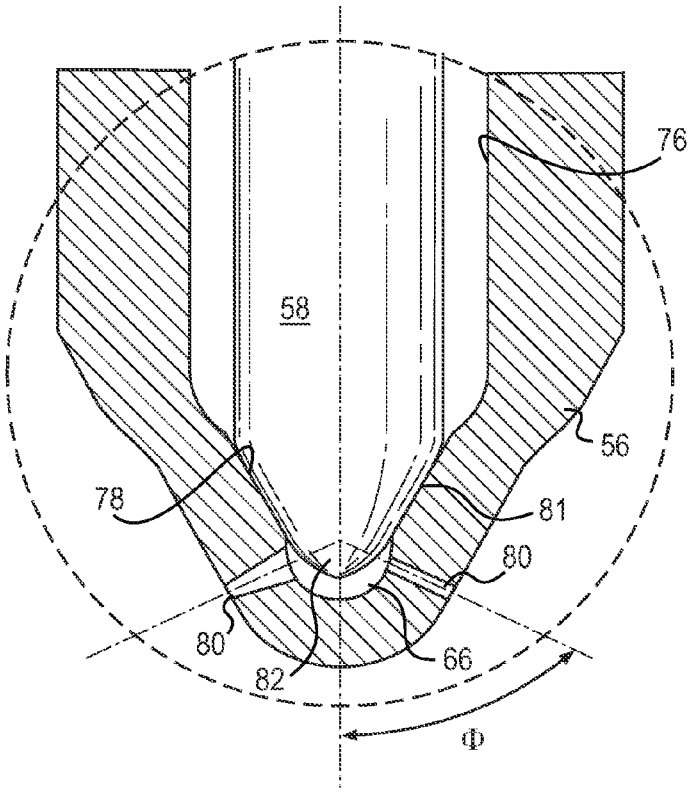
FIG. 3A is an illustration of an exemplary disclosed nozzle for the fuel injector of FIG. 2.

As illustrated in FIG. 3A, nozzle member 56 may be a cylindrical member, having a central bore 76 of blind depth that is configured to receive needle valve element 58. Nozzle member 56 may include a seating surface 78 located toward tip end 64 of nozzle member 56. Tip end 64 of nozzle member 56 may include a sac 66. One or more orifices 80 may be disposed in communication with sac 66 within a wall of tip end 64. Each of the orifices 80 may redirect pressurized fuel from sac 66 through orifices 80 to spray into an associated combustion chamber 22 of engine 10.

Orifices 80 may be skewed at a zenith angle $\phi$ with respect to central bore 76. Zenith angle $\phi$ is the angle made by a central axis of an orifice 80 with respect to a central axis of central bore 76. For example, the angle $\phi$ in FIG. 3A shows the zenith angle for an orifice 80. The magnitude of zenith angle $\phi$ may be selected, for example, to ensure that the fuel spray from orifices 80 wets some or all portions of piston 18. Zenith angle $\phi$ may also be selected based on other design considerations, readily apparent to one skilled in the art, for promoting mixing of fuel and air in combustion chamber 22. Orifices 80 may be cylindrical or conical in shape. One skilled in the art will recognize, however, that orifices 80 may have any other type of appropriate shape. The shape, size, and number of orifices 80 may be selected to ensure sufficient fuel can be injected into combustion chamber 22 and to ensure the injected fuel is properly atomized and mixed with the air in combustion chamber 22. In one exemplary embodiment, a diameter of an orifice 80 may be about 0.3 to 0.45 mm.

Figure 3B:
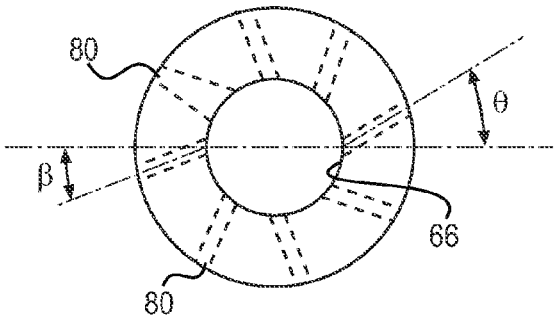
FIG. 3B is a cross-sectional illustration of the orifices of an exemplary disclosed nozzle of FIG. 3A.

As illustrated in FIG. 3B, one or more of the orifices 80 may be skewed at an azimuthal angle $\theta$ with respect to a radial direction of central bore 76. Azimuthal angle $\theta$ is the angle made by a central axis of an orifice 80 with respect to a radial direction of central bore 76 that intersects the central axis of orifice 80 as measured on a plane orthogonal to the central bore. For example, the angle $\theta$ in FIG. 3B show the azimuthal angles for an orifice 80. The magnitude of azimuthal angle $\theta$ may be selected such that fuel sprayed from an orifice 80 does not interact with fuel sprayed from an adjacent orifice 80. Further, the magnitude of azimuthal angle $\theta$ may be selected to ensure that fuel does not wet the walls of combustion chamber 22. Wetting of combustion chamber walls by fuel is undesirable because it may promote soot formation during combustion. Thus, for example, skewing the orifices instead of spraying fuel out radially may increase the distance that the fuel spray must travel before reaching a wall of combustion chamber 22, thereby reducing the likelihood of wetting the walls of combustion chamber 22. It is contemplated that each of the orifices 80 may be skewed at the same or at different azimuthal angles with respect to radial directions of central bore 76. For example, FIG. 3B illustrates two orifices 80, one skewed at an azimuthal angle $\theta$ and the other skewed at a different azimuthal angle $\beta$. In some embodiments, the magnitudes of azimuthal angles $\theta$ and $\beta$ may be equal. As illustrated in FIG. 3B, orifices 80 are skewed at positive azimuthal angles $\theta$ or $\beta$ relative to radial directions of central bore 76. It is contemplated that orifices 80 may be skewed at negative azimuthal angles $\theta$ or $\beta$ relative to radial directions of central bore 76. In an exemplary embodiment, azimuthal angles $\theta$ and $\beta$ may range from 0 to 6 degrees.

Needle valve element 58 may be an elongated cylindrical member that is slidingly disposed within housing guide 54 and nozzle member 56. Needle valve element 58 may be axially movable between a first position at which a sealing surface 81 located at a tip end 82 of needle valve element 58 engages seating surface 78 to block a flow of fuel to sac 66 and orifices 80, and a second position at which fuel flows into sac 66 and may be directed through orifices 80 into combustion chamber 22.

Needle valve element 58 may be normally biased toward the first position. In particular, as seen in FIG. 2, each fuel injector 32 may include a spring 90 disposed between a stop 92 of guide 54 and a seating surface 94 of needle valve element 58 to axially bias tip end 82 toward the orifice-blocking position. A first spacer 96 may be disposed between spring 90 and stop 92, and a second spacer 98 may be disposed between spring 90 and seating surface 94 to reduce wear of the components within fuel injector 32.

Needle valve element 58 may have multiple driving hydraulic surfaces. In particular, needle valve element 58 may include a hydraulic surface 100 tending to drive needle valve element 58 toward the first position when acted upon by pressurized fuel within control chamber 70, and a hydraulic surface 104 that tends to oppose the bias of spring 90 and drive needle valve element 58 in the opposite direction toward the second position. When biased toward the second position, needle valve element 58 may be configured to substantially restrict or even block off the flow of fuel through supply passageway 75.

INDUSTRIAL APPLICABILITY

The fuel injector of the present disclosure has wide applications in a variety of engine types including, for example, diesel engines, gasoline engines, and gaseous fuel-powered engines. The disclosed fuel injector may be implemented into any engine that utilizes a pressurizing fuel system wherein it may be advantageous to skew the angle at which fuel is sprayed into a combustion chamber. The operation of fuel injector 32 will now be explained.

Needle valve element 58 may be moved by an imbalance of force generated by fluid pressure. For example, when needle valve element 58 is seated against seating surface 78 in the first or flow-blocking position, pressurized fuel from fuel supply and control passageways 75 and 73 may flow into control chamber 70 to act on hydraulic surface 100. Simultaneously, pressurized fuel from fuel supply passageway 71 may flow into central bore 68 in anticipation of injection. The force of spring 90 combined with the hydraulic force created at hydraulic surface 100 may be greater than an opposing force created at hydraulic surface 104 thereby causing needle valve element 58 to remain in the first position and block fuel flow to sac 66 and through orifices 80. To allow fuel to flow into sac 66, pressurized fuel may be drained away from control chamber 70 and hydraulic surface 100. This decrease in pressure acting on hydraulic surface 100 may allow the opposing force acting across hydraulic surface 104 to overcome the biasing force of spring 90, thereby moving sealing surface 81 of needle valve element 58 away from seating surface 78.

The disclosed fuel injector may improve atomization and mixing of fuel with air as a result of the skewed fuel injection into the combustion chamber. Selection of the azimuthal angle will now be described. Air entering combustion chamber 22 during an air intake stroke of piston 18 may include a swirl component to the air velocity. For example, air may swirl around combustion chamber 22 either in a clockwise or a counter-clockwise direction. Directing a spray of fuel in the direction of swirl or against the direction of swirl may improve atomization of the fuel and promote mixing of the fuel with air. Improved atomization and mixing of fuel with air may increase the efficiency of combustion in combustion chamber 22 and may also improve fuel consumption and reduce soot formation.

Whether to spray fuel in the direction of swirl or against the direction of swirl may be determined at least in part by the pressure at which fuel is injected into combustion chamber 22. Fuel sprayed by orifices 80 at relatively higher fuel injection pressures may penetrate larger distances in combustion chamber 22 and may be more likely to wet the walls of combustion chamber 22. At relatively high fuel injection pressures, it may be advantageous to spray fuel from orifices 80 in the direction of air swirl to help prevent fuel from wetting the walls of combustion chamber 22. Preventing fuel from wetting the walls of combustion chamber 22 may help to reduce the formation of soot during combustion of the fuel. Thus, for example, when the air in combustion chamber 22 has a swirl in the counter-clockwise direction corresponding to a swirl number of 3.1 and the fuel injection pressure is greater than about 110 MPa, it may be advantageous to select a fuel injector in which azimuthal angles $\theta$ and $\beta$ of orifices 80 are positive.

Fuel sprayed at lower injection pressures, in contrast, may be subject to incomplete atomization and may not be able to mix well with air in combustion chamber 22. Spraying fuel against the direction of swirl at lower injection pressures may allow the fuel spray to interact with a larger surface area of air, which may improve atomization of the fuel and may also result in better mixing of the fuel with air. Thus, for example, when air entering combustion chamber 22 has a swirl in the counter-clockwise direction corresponding to a swirl number of 3.1 and the fuel injection pressure is lower than or equal to about 110 Mpa, it may be advantageous to select a fuel injector in which azimuthal angles $\theta$ and $\beta$ of orifices 80 are negative. It is contemplated that fuel may be sprayed in the direction of swirl or against the direction of swirl regardless of the fuel injection pressure. Larger improvements in fuel efficiency and larger reductions in soot formation may be achieved by spraying fuel in the direction of swirl at higher injection pressures and against the direction of swirl at lower injection pressures.

It will be apparent to those skilled in the art that various modifications and variations can be made to the disclosed fuel injector nozzle without departing from the scope of the disclosure. Other embodiments of the fuel injector nozzle will be apparent to those skilled in the art from consideration of the specification and practice of the fuel injector nozzle disclosed herein. It is intended that the specification and examples be considered as exemplary only, with a true scope of the disclosure being indicated by the following claims and their equivalents.

What is claimed is:

1. A nozzle for a fuel injector, comprising:
- a body having a base end, a tip end, and a central bore extending from the base end to the tip end;
- a sac located within the central bore at the tip end; and
- a plurality of orifices located within the tip end and in communication with the sac, each orifice being skewed at an azimuthal angle, which is positive relative to a radial direction of the central bore, wherein the orifices include:
  - a first orifice skewed at a first azimuthal angle relative to a radial direction of the central bore, and
  - a second orifice skewed at a second azimuthal angle relative to a radial direction of the central bore,
  - wherein the first azimuthal angle and the second azimuthal angle are unequal.

2. The nozzle of claim 1, wherein the each orifice is also skewed at a zenith angle relative to the central bore.

3. The nozzle of claim 1, wherein the first and second azimuthal angles have a magnitude of about 0 to 6 degrees.

4. A method of injecting fuel in an engine having a combustion chamber, the method comprising:
- pressurizing fuel;
- directing a flow of pressurized fuel through a central bore of a nozzle member to a sac, the central bore extending from a base end to a tip end;

redirecting the fuel through a first orifice to the combustion chamber in a direction skewed at a first azimuthal angle relative to a radial direction of the central bore, the first orifice being disposed within a wall at the tip end and having a conical shape; and redirecting the fuel through a second orifice to the combustion chamber in a direction skewed at a second azimuthal angle relative to a radial direction of the central bore, wherein the first azimuthal angle is different from the second azimuthal angle.

5. The method of claim 4 further including:

redirecting the fuel through each orifice to the combustion chamber in a direction which is also skewed at a zenith angle relative to the central bore.

6. The method of claim 5 further including:

determining a direction of air swirl in the combustion chamber;

determining a pressure of the fuel flowing through the central bore; and selecting each azimuthal angle based on the direction of air swirl and the pressure of the fuel.

7. The method of claim 6, wherein the magnitude of each azimuthal angle is about 0 to 6 degrees.

8. The method of claim 6, wherein the azimuthal angle of each orifice redirects fuel against the direction of air swirl when the pressure of the fuel is lower than a predetermined pressure.

9. The method of claim 6, wherein the azimuthal angle of each orifice redirects fuel in the direction of swirl when the pressure of the fuel is higher than a predetermined pressure.

10. The method of claim 9, wherein the predetermined pressure is about 110 MPa.

11. A fuel injector, comprising:

a body;

a needle valve element disposed within the body;

a control chamber formed within the body at a base end of the needle valve element; and a nozzle member including:

a base end, a tip end, and a central bore extending from the base end to the tip end, the central bore being configured to slidingly receive the needle valve element;

a sac located within the central bore at the tip end of the nozzle member; and a plurality of orifices located within the tip end and in communication with the sac, each orifice being skewed at an azimuthal angle, which is positive relative to a radial direction of the central bore, wherein the orifices include:

a first orifice skewed at a first azimuthal angle relative to a radial direction of the central bore; and a second orifice skewed at a second azimuthal angle relative to a radial direction of the central bore, wherein the first azimuthal angle is different from the second azimuthal angle.

12. The fuel injector of claim 11, wherein the each orifice is skewed at a zenith angle relative to the central bore.

13. The nozzle of claim 1, wherein the first and second orifices are disposed within a wall at the tip end and at least one of the first and second orifices has a conical shape.

* * * * *